US010876695B2

(12) United States Patent
Stein et al.

(10) Patent No.: US 10,876,695 B2
(45) **Date of Patent: *Dec. 29, 2020**

(54) MOTOR VEHICLE HEADLIGHT FOR EMITTING A LONG-RANGE LIGHT PATTERN

(71) Applicant: ZKW Group GmbH, Wieselburg (AT)

(72) Inventors: Martin Stein, Zarsdorf (AT); Christian Bemmer, Klein-Poechlarn (AT); Thomas Edletzberger, Loosdorf (AT); Martin Schragl, Zarnsdorf (AT); Peter Schadenhofer, Roggendorf (AT); Jürgen Ganzberger, St. Georgen am Steinfelde (AT); Johann Altmann, Gmünd (AT); Jürgen Zorn, Rossatz (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

This patent is subject to a terminal disclaimer.

(21) Appl. No.: 16/535,554

(22) Filed: Aug. 8, 2019

(65) Prior Publication Data

US 2019/0390833 A1 Dec. 26, 2019

Related U.S. Application Data

(63) Continuation of application No. 15/757,673, filed as application No. PCT/AT2016/060059 on Sep. 15, 2016, now Pat. No. 10,408,407.

(30) Foreign Application Priority Data

Sep. 17, 2015 (AT) ..... A50797/2015

(51) Int. Cl.
*F21S 41/14* (2018.01)
*F21S 41/19* (2018.01)
(Continued)

(52) U.S. Cl.
CPC ..... *F21S 41/18* (2018.01); *F21S 41/143* (2018.01); *F21S 41/16* (2018.01); *F21S 41/19* (2018.01);
(Continued)

(58) Field of Classification Search
CPC ..... F21S 41/141–155; F21S 41/16; F21S 41/176; F21S 41/18; B60Q 1/02–245
See application file for complete search history.

(56) References Cited

U.S. PATENT DOCUMENTS 6,123,440 A * 9/2000 Albou ..... F21V 7/07 362/516
7,699,513 B2 4/2010 Nakada et al.
(Continued)

FOREIGN PATENT DOCUMENTS

AT 514402 T 2/2014
EP 1881264 A1 1/2008
(Continued)

OTHER PUBLICATIONS

Office Action issued in Austrian Application No. A 5079712015, dated Jul. 13, 2016 (3 pages).
(Continued)

*Primary Examiner* — Sean P Gramling
(74) *Attorney, Agent, or Firm* — Eversheds Sutherland (US) LLP

(57) ABSTRACT

A light module for a motor vehicle headlight for emitting light to form a light pattern in an area in front of the light module, the light module including two or more primary light sources (PLQ1, PLQ2) that produce light to form a main light pattern (HLV), and at least one secondary light source (SLQ1) that produces light to form an additional light pattern (ZLV), which overlaps the main light pattern to form an entire light pattern. The primary light sources are asso-
(Continued)

ciated with at least one primary reflector (PR1, PR2) and are configured to bundle the light emitted the from the primary light sources and to direct it in the form of the main light pattern into an area in front of the light module. The at least one secondary light source is associated with an optical imaging system (AS) and is configured to project the light emitted from the at least one secondary light source in the form of the additional light pattern into an area in front of the light module, wherein the main light pattern is in the form of a short-range light pattern and the additional light pattern is in the form of a long-range light pattern and the entire light pattern (LFL) is in the form of a long-range light pattern.

30 Claims, 4 Drawing Sheets

(51) Int. Cl.

| | |
|---|---|
| ***F21S 41/143*** | (2018.01) |
| ***F21S 41/663*** | (2018.01) |
| ***F21S 45/49*** | (2018.01) |
| ***F21S 41/16*** | (2018.01) |
| *F21Y 115/10* | (2016.01) |

(52) U.S. Cl.
CPC ..... *F21S 41/663* (2018.01); *F21S 45/49* (2018.01); *F21Y 2115/10* (2016.08)

(56) References Cited

U.S. PATENT DOCUMENTS

| | | | | |
|---|---|---|---|---|
| 9,175,824 | B2 | 11/2015 | Nakazato et al. | |
| 9,476,555 | B2 | 10/2016 | Brendle et al. | |
| 9,539,931 | B2 | 1/2017 | Kato et al. | |
| 9,651,210 | B2 | 5/2017 | Ziegler et al. | |
| 2005/0141227 | A1* | 6/2005 | Tsukamoto ..... | F21S 41/147 362/487 |
| 2007/0201241 | A1 | 8/2007 | Komatsu | |
| 2009/0290372 | A1 | 11/2009 | Kotajima et al. | |
| 2010/0296306 | A1 | 11/2010 | Toyoyama et al. | |
| 2013/0027951 | A1* | 1/2013 | Takahashi ..... | B60Q 1/085 362/465 |
| 2015/0049504 | A1 | 2/2015 | Wu | |
| 2015/0062894 | A1 | 3/2015 | Dennis | |
| 2016/0084465 | A1* | 3/2016 | Yamamoto ..... | F21S 41/148 362/517 |
| 2016/0272106 | A1 | 9/2016 | Kato et al. | |

FOREIGN PATENT DOCUMENTS

| | | | |
|---|---|---|---|
| EP | 1980787 | B1 | 4/2008 |
| EP | 2390561 | B1 | 11/2011 |
| EP | 2551154 | A2 | 1/2013 |
| EP | 2772682 | A2 | 9/2014 |

OTHER PUBLICATIONS

International Search Report and Written Opinion for PCT/AT2016/060059, dated Mar. 9, 2017 (16 pages).
European Search Report, EP Application No. 1820334.1, dated Feb. 15, 2019 (8 Pages).
Communication from the Examining Division, EP Application No. 16770871.8, dated Apr. 12, 2019 (2 Pages).

* cited by examiner

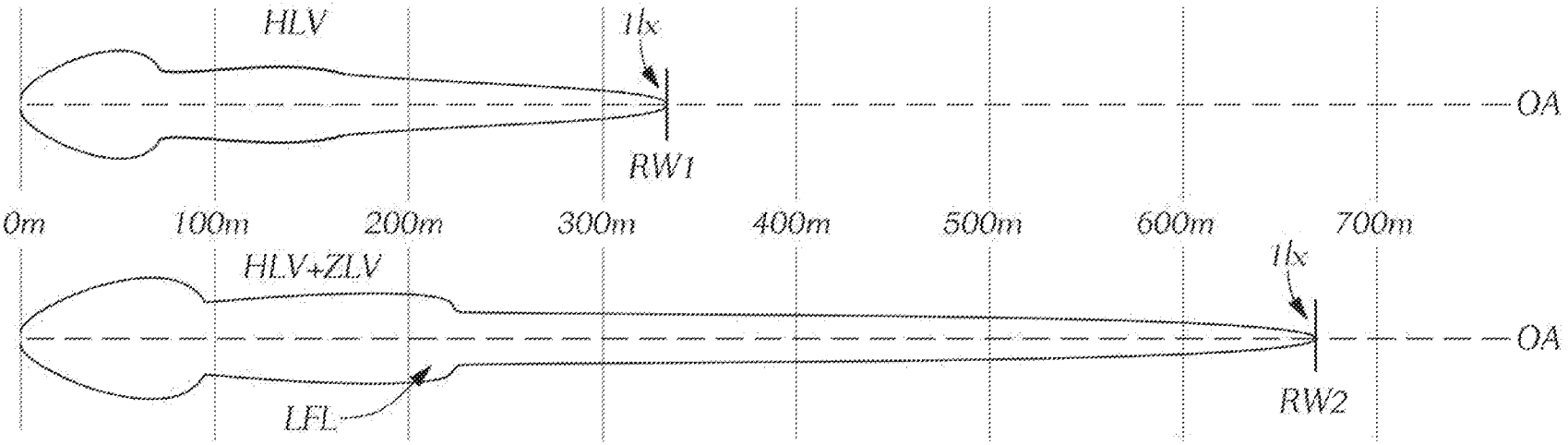
Fig. 2
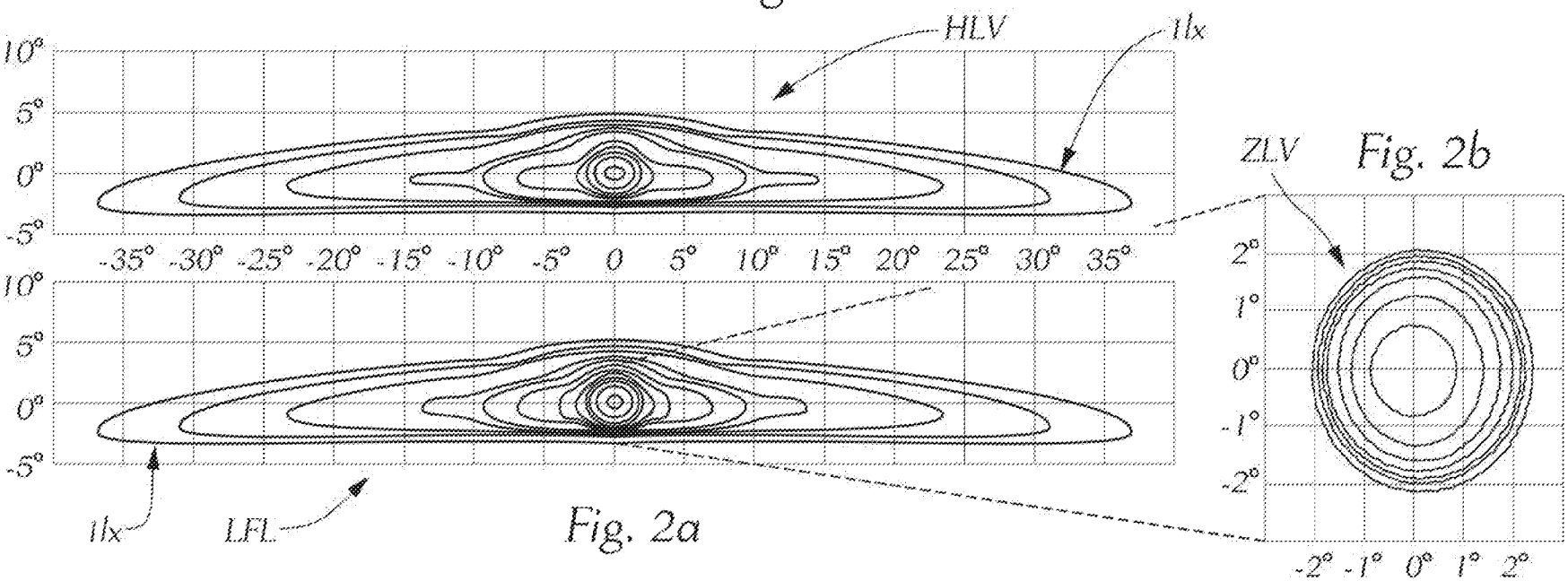
Fig. 2b
Fig. 2a

MOTOR VEHICLE HEADLIGHT FOR EMITTING A LONG-RANGE LIGHT PATTERN

CROSS-REFERENCE TO RELATED APPLICATIONS

This application is a continuation of U.S. application Ser. No. 15/757,673, filed Mar. 6, 2018, which is the national stage of PCT/AT2016/060059, filed Sep. 15, 2016, which claims priority to Austrian Application No. A50797/2015, filed Sep. 17, 2015. These application are incorporated herein by reference.

FIELD OF THE INVENTION

The invention relates to a light module for a motor vehicle headlight for emitting light to form a light pattern in an area in front of the light module, the light module comprising two or more primary light sources that produce light to form a main light pattern and at least one secondary light source that produces light to form an additional light pattern, the additional light pattern overlapping the main light pattern to form an entire light pattern, the primary light sources being associated with at least one primary reflector and being set up to bundle the light emitted the from the primary light sources and to direct it in the form of the main light pattern into an area in front of the light module, an optical imaging system being associated with the at least one secondary light source and being set up to project the light emitted from the at least one secondary light source in the form of the additional light pattern into an area in front of the light module.

Furthermore, the invention relates to a lighting device for a motor vehicle headlight with such a light module.

Moreover, the invention relates to a motor vehicle headlight with at least one light module of the type mentioned at the beginning and/or with at least one lighting device of the type mentioned above.

In addition, the invention relates to a motor vehicle with at least one such motor vehicle headlight.

BACKGROUND

Modern motor vehicle construction more and more frequently emphasizes design freedom and compactness of motor vehicle headlights. However, the wish for more functionality and efficiency often runs counter to this, for which reason, e.g., laser light sources and LED light sources are more and more frequently used in combination in light modules to form light patterns, especially high beam patterns.

The term "functionality" should be understood to mean that it should be possible to realize a two-stage high beam light pattern, wherein the first stage should achieve the legal minimum illuminance and/or the specified minimum distance of a high beam light pattern, and the second stage should achieve the legal maximum illuminance and/or the specified maximum distance or the maximum range/performance/safety.

Furthermore, combined use of laser light sources and LED light sources places especially high requirements on the adjustment of the individual units with respect to one another, such as, e.g., making the optical axes parallel in a simple and compact form by means of a defined (minimum) number of adjusting elements/screws.

A laser light unit that can be used in a motor vehicle headlight consists of at least one laser light source (laser diode) and at least one light conversion means (called a phosphor for short), since no laser light may be emitted directly onto the road. Such laser light units are the best choices because of their size and their emission characteristics. Laser light units produce the light to produce a light pattern by irradiating the phosphor with laser light. An optical imaging system in front (with reference to the main emission direction of the laser light unit) of the light source (i.e., the laser beam-illuminated area of the phosphor) projects, as a light pattern in front of the laser unit (and, when the laser unit is installed in a motor vehicle headlight, in front of the motor vehicle headlight), this light source, which can be relatively small (usually 100-900 microns, preferably smaller than 600 microns). Consequently, the laser light unit can also have a space-saving design. A laser light unit produces a bright and long-range light pattern.

By contrast, LED light sources are good for producing a wide light pattern, or at least parts of a wide light pattern. (The advantages of such a combination have already been described in WO2012161170A1, EP2551154A2, or in DE102013200925A1, among other places.)

SUMMARY OF THE INVENTION

The goal of this invention is to create a light module that eliminates the above-mentioned disadvantages of the prior art and that meets the corresponding requirements on illuminating engineering, design, and electronics.

The invention accomplishes this with a light module of the type mentioned at the beginning wherein the main light pattern is in the form of a short-range light pattern and the additional light pattern is in the form of a long-range light pattern and the entire light pattern is in the form of a long-range light pattern.

In the context of this invention, the "range" of a light pattern is understood to mean the distance between the motor vehicle headlight and a line lying transverse to the optical axis of the motor vehicle headlight (transverse to the main emission direction of the motor vehicle headlight) at which the illuminance falls below one lux. Here please refer to FIG. 2, which will be used to explain the term "range" in greater detail.

In the context of this invention, the term "short-range light pattern" is understood to mean a light pattern with a range less than 350 meters, preferably with a range between 100 meters and 350 meters.

In the context of this invention, the term "long-range light pattern" is understood to mean a light pattern with a range more than 400 meters, preferably with a range between 400 meters and 700 meters. With respect to the parallelism of the light bundle produced by the light module, it is advantageous if the at least one primary reflector is in the form of a paraboloidal reflector.

In the context of this invention and consistent with tried and tested practice, the term "paraboloidal reflector" is preferably understood to mean a reflector whose reflective surface has one, two, or more segments, each of which can be essentially in the form of a part of a paraboloid of revolution that is theoretically infinitely large.

The paraboloidal reflector is designed so that the light produced by a light source arranged at the focal point of a paraboloidal reflector propagates as a light bundle, a vertical section of the light bundle having light beams that propagate essentially parallel to one another and a horizontal section of the light bundle having light beams that essentially diverge from one another.

The terms "vertical" and "horizontal" relate to a light module installed in a motor vehicle.

A form of the invention that has been tried and true in practice provides that the two or more primary light sources be in the form of LEDs.

With respect to the controller, it can be advantageous if every primary light source is associated with exactly one primary reflector.

With respect to the production of the primary reflectors, if there are two or more primary reflectors, it can be advantageous for all primary reflectors to be made together in a single piece.

A further development of the invention can provide that if there are two or more primary reflectors, all primary reflectors be separate from one another.

It can be useful for every primary light source to be arranged at a focal point of the at least one primary reflector.

A preferred embodiment of this invention can provide that the at least one secondary light source be in the form of light conversion means of a laser light unit.

Moreover, it can advantageously be provided that the primary light sources be in the form of light sources of one type, preferably in the form of LEDs, and that the at least one secondary light source be in the form of a light source of another type, preferably in the form of light conversion means of a laser light unit.

This has the advantage, for example, that if the at least one secondary light source should turn off for safety-related reasons, the primary light sources alone can produce light to form a short-range light pattern meeting legal standards. The short-range light pattern can be in the form of a high beam light pattern.

It is entirely conceivable for the means of light conversion to be illuminated by two or more laser light sources (directly or indirectly, that is through light deflection means, for example a mirror or a micromirror). It can further be provided that if there are two or more secondary light sources, every secondary light source is in the form of light conversion means or that every secondary light source is in the form of an area of the light conversion means, every area of a laser light source being (directly or indirectly) illuminated and these areas being disjoint (not overlapping).

Furthermore, it can be advantageous for the optical imaging system to have at least one secondary reflector, preferably a free form reflector.

With respect to the installation depth of the light module, it is especially advantageous if the optical imaging system has at least one hyperboloid reflector.

In the context of this invention and consistent with tried and tested practice, the term "hyperboloid reflector" is preferably understood to mean a reflector whose reflective surface has one, two, or more segments, it being possible for each segment to be essentially part of a hyperboloid that is theoretically infinitely large.

It can be provided that the hyperboloid reflector has auxiliary optics in front of it.

With respect to the adjustment of the light module, it can be expedient if there is a collimator lens in front of the hyperboloid reflector, the at least one secondary light source preferably being arranged in a real focal point of the hyperboloid reflector, and the focal point of the collimator lens preferably coinciding with the virtual focal point of the hyperboloid reflector.

It can be provided that a secondary reflector focal length is equal to the at least one primary reflector focal length.

In the context of this invention, the term "focal length" is understood to mean the distance between the principal plane and the focal point. In optical imaging systems, which can comprise, for example, reflectors, lenses, mirrors, prisms, diaphragms, etc., it is natural to distinguish between an object space and an image space. Moreover, the technical literature discusses real and virtual images and real and virtual focal points, depending on the imaging properties of an optical system. For example, a biconcave lens (and/or a hyperboloid reflector) has a real and a virtual focal point.

It can be advantageous, if there are two or more primary reflectors, for the primary reflector focal lengths to be the same.

To increase the quality of the emitted light pattern, it can be provided that an optical axis of the imaging system and an optical axis of the at least one primary reflector are oriented essentially parallel to one another.

It can be useful, if there are two or more primary reflectors, for all their optical axes to be oriented parallel to one another and for the optical axis of the imaging system to be oriented essentially parallel to the optical axes of the primary reflectors.

Moreover, it can be advantageous if the primary light sources are arranged so that the at least one secondary light source is surround by the primary light sources/arranged between the primary light sources.

The goals mentioned at the beginning are further accomplished with a lighting device that has a supporting frame, a main support, and an additional support, the supporting frame being set up to receive the main support and the additional support, the main support being set up to receive the primary light sources and the at least one primary reflector, and the additional support being set up to receive the at least one secondary light source and the optical imaging system.

A preferred embodiment can provide that the main support and/or the additional support is/are each in the form of a heat sink.

With respect to the adjustability of the lighting device, it can be advantageous if the main support and the supporting frame are associated with at least one first adjustment triangle system to adjust the main support with respect to the supporting frame.

Moreover, it can advantageously be provided that the additional support and the supporting frame are associated with at least one second adjustment triangle system to adjust the additional support with respect to the supporting frame.

In the context of this invention, the term "adjustment triangle system" is generally understood to mean an adjustment system that adjusts the support with respect to the supporting frame through three actuating elements (e.g., adjusting screws), which are pivotably connected with the corresponding support and with the supporting frame. The adjustment is normally done by means of mechanical and/or electric motor actuation means, which are associated with the lighting device. Such adjustment systems are known in the prior art (see, e.g., the applicant's application A 50329/2013).

It can be useful if the supporting frame is pivotable about at least one axis. The light module can be used to produce, e.g., curve light light patterns.

With respect to the size of the lighting device, it can advantageously be provided that the supporting frame is arranged between the additional support and the main support.

It is advantageous if the supporting frame is arranged behind the main support and the additional support is arranged behind the supporting frame.

Here the term "behind" means that the supporting frame is arranged opposite the direction of travel/light exit direction from the main support, and the additional support is arranged opposite the direction of travel/light exit direction from the supporting frame.

A preferred embodiment can provide that the secondary light source be in the form of light conversion means of a laser light unit, and that the laser light unit be arranged in a laser light unit housing, this housing being elongated and being arranged [in] and guidable through a receiving opening in the supporting frame, this receiving opening being set up to receive the laser light unit housing. With respect to the connection of the adjustment triangle systems with the supporting frame and the main support, it can be advantageous if the supporting frame has at least three passages and if the main support has at least three receiving sockets, every receiving socket of the main support corresponding to one passage of the supporting frame.

With respect to the connection of the adjustment triangle systems with the additional support and the supporting frame, it can be advantageous if the additional support has at least three passages and the supporting frame has at least three receiving sockets, each receiving socket of the supporting frame corresponding to one passage of the additional support.

BRIEF DESCRIPTION OF THE DRAWINGS

The invention along with other advantages is explained in detail below using preferred, non-restrictive sample embodiments, which are illustrated in a drawing. The figures are as follows:

FIG. 2 is a top view of a main light pattern in the form of a short-range high beam light pattern and an entire light pattern in the form of a long-range high beam light pattern;

FIG. 2*a* is a short-range high beam light pattern according to FIG. 2, a long-range additional partial high beam light pattern according to FIG. 2, and an additional light pattern in the form of a long-range high beam light pattern;

FIG. 2*b* is a long-range additional light pattern ZLV according to FIG. 2*a;*

DETAILED DESCRIPTION

Figure 1:
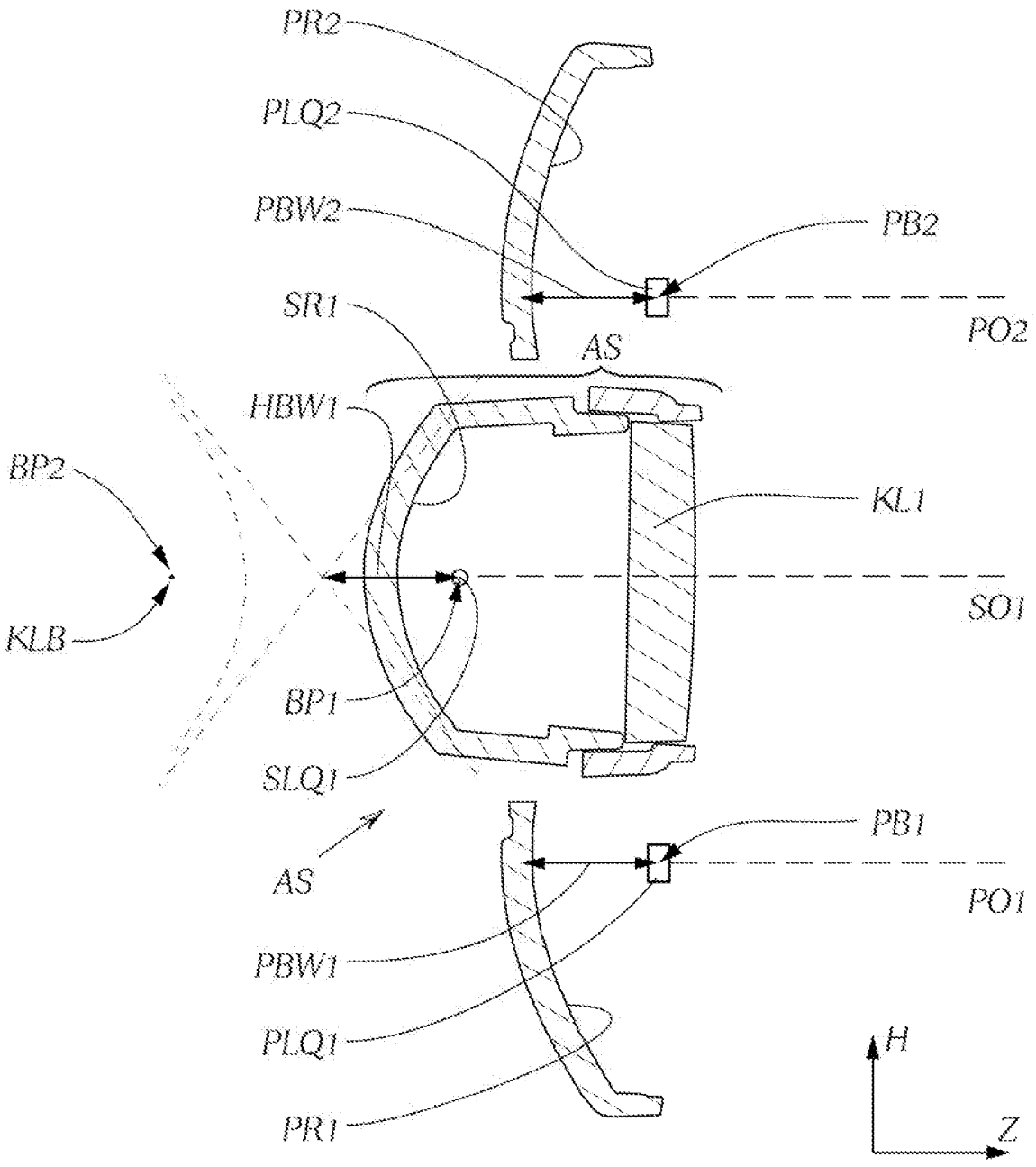
FIG. 1 schematically illustrates the components that are essential for the invention and their relationship.

First, please refer to FIG. 1. This figure shows a sample schematic arrangement of the components that are decisive for the inventive light module. The light module has two primary light sources PLQ1, PLQ2, each of which has a primary reflector PR1, PR2 associated with a primary light source, and a secondary light source SLQ1 with an associated optical imaging system AS consisting of a secondary reflector SR1 and a lens KL1. The primary light sources PLQ1, PLQ2 which here are in the form of light-emitting diodes (LED) are set up to produce light to form a main light pattern HLV (FIG. 2). The main light pattern HLV normally has a relatively short range. However, in many traffic situations it is necessary to increase the range of the emitted main light pattern. To achieve this goal, the invention provides the secondary light source SLQ1, which in FIG. 1 is in the form of light conversion means (in technical language often referred to as a phosphor) of a laser light unit (not shown). The use of laser light units in motor vehicle headlights is known in the prior art (see, e.g., FIGS. 3 and 7 in EP 2551154 A2). According to the invention, the laser light unit has such a laser light source (not shown) and such light conversion means SLQ1 that, when illuminated, give off sufficient luminous flux in a specified solid angle, preferably one that is small in relation to $47\pi$ (total solid angle). This causes the secondary light source SLQ1 to produce (by converting the laser light at the light conversion means SLQ1) light to form a long-range additional light pattern ZLV (FIG. 2*b*). The primary reflectors PR1, PR2 associated with the primary light sources PLQ1, PLQ2 bundle the light emitted by the primary light sources PLQ1, PLQ2 and direct it into an area in front of the light module. The term "in front of the light module" refers to an area that lies in the light propagation direction of the light bundled by the primary reflectors PLQ1, PLQ2. Here it should also be mentioned that the "bundled light" can be in the form of a converging or diverging or parallel light bundle. The primary reflectors PR1, PR2 are preferably in the form of paraboloidal reflectors and bundle (in the vertical direction V, with reference to a light module that is installed in a motor vehicle headlight) the light produced by the primary light sources PLQ1, PLQ2, which are preferably arranged in a focal point PB1, PB2 of the respective primary reflector PR1, PR2, into an essentially parallel light bundle. Moreover, the primary reflectors PR1, PR2 can made together in a single piece or separately from one another. The imaging system associated with the secondary light source SLQ1 has, as was briefly explained above, the secondary reflector SR1 and the lens KL1. The secondary reflector SR1 is preferably in the form of a hyperboloid reflector and the lens KL1 is preferably in the form of a collimator lens. The hyperboloid reflector SR1 has two focal points BP1, BP2, the first focal point BP1 being a real focal point, at which the secondary light source SLQ1 (in this case the light conversion means) is arranged, and the second focal point BP2 being a virtual focal point, at which the extensions LS' (see FIG. 4) of the light beams LS coming from the real focal point BP1 and reflected from the reflective surface of the hyperboloid reflector (see FIG. 4) essentially meet. The collimator lens KL1 is arranged in such a way that one of its focal points KLB coincides with the virtual focal point BP2. This bundles the light reflected from the hyperboloid reflector SR1 into an essentially parallel (in the vertical direction V) light bundle. However, the concentration into an essentially parallel light bundle is not necessary. It is entirely conceivable to use a converging lens or diverging lens instead of a collimator lens. What lens is used here can [depend], for example, on the type of auxiliary optics in front of the light module or of another optical imaging system that might be present (i.e., e.g., an arrangement of diaphragms, lenses, mirrors, etc.) and on the requirements on the shape of the main light pattern and/or the additional light pattern and/or the light pattern produced by the light module.

It is also preferred that all real focal lengths (i.e., the distance between the principal plane and the focal point, in the case of the hyperboloid reflector the real focal point at which the secondary light source is arranged) PBW1, PBW2, HBW1 of all reflectors used in this invention be essentially the same. This can minimize the installation depth of the light module and thereby take into account the design freedom and compactness that are more and more frequently emphasized in today's headlights.

Moreover, the primary reflectors and the secondary reflector are arranged so that their optical axes PO1, PO2, SO1 run parallel to one another. This is especially relevant for the quality of the emitted light pattern.

The arrangement of the essential components of the invention shown in FIG. 1 is especially advantageous for a light module, if the light module is set up to produce an entire light pattern in the form of a long-range high beam light pattern LFL (FIG. 2*a*). The primary light sources PLQ1, PLQ2 produce, in cooperation with the primary reflectors, a short-range high beam light pattern HLV (FIG. 2), which short-range high beam light pattern HLV is overlapped by a long-range additional partial high beam light pattern ZLV (FIG. 2*b*) and thereby forms the long-range high beam light pattern LFL (FIG. 2*a*), that is the entire light pattern. The 1 lux range of the long-range high beam light pattern LFL, which is measured by measuring the distance between the light module and the 1 lux line, is essentially twice as large as the range of the short-range high beam light pattern ZLV. The additional partial high beam light pattern ZLV is arranged essentially in the middle of the short-range high beam light pattern HLV (FIG. 2*a*). This advantageous effect is achieved by arranging the primary light sources PLQ1, PLQ2 and the primary reflectors PR1, PR2 with respect to the secondary light source SLQ1 and the imaging system AS in the way schematically shown in FIG. 1, this arrangement involving the primary light sources PLQ1, PLQ2 "surrounding" the secondary light source SLQ1. Finally, this means that if the positions of the primary and secondary light sources (the light conversion means) are projected onto a plane arranged perpendicular to the optical axes PO1, PO2, SO1 of the corresponding reflectors PR1, PR2, SRL the projections of the primary light sources P1, P2 surround the projection of the secondary light source S1.

Figure 3:
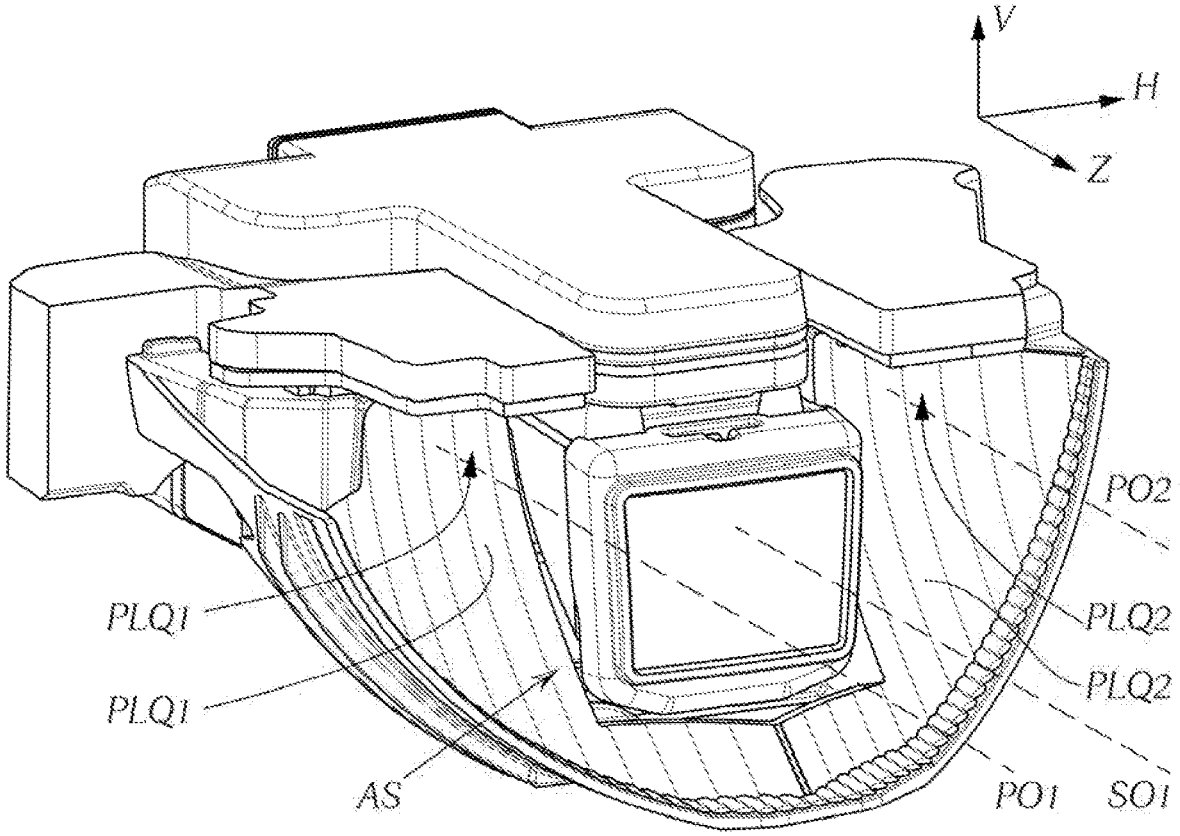
FIG. 3 is a perspective view of an inventive light module.

FIG. 3 shows a perspective view of an inventive light module that is ready to be installed. The coordinates shown designate the light exit direction/main emission direction Z, and the horizontal direction H, which is normal to Z and normal to the vertical direction V. Here the terms "horizontal" and "vertical" relate to the state of the light module in which it is installed in a motor vehicle headlight, which in turn is installed in a vehicle. The primary light sources PLQ1, PLQ 2 and the primary reflectors PR1, PR2 are combined into a first complete unit (LED unit), and the secondary light source and the optical imaging system AS are combined into a second complete unit, preferably into a laser light unit. That is, in view of what was said above, all in all the laser light unit comprises, as was briefly mentioned above, a laser light source, which produces light to irradiate the light conversion means, these light conversion means functioning as the secondary light source, and an optical imaging system AS, which projects, in front of the light module, the light produced by converting the laser light on the light conversion means. Moreover, the primary reflector PR1 of the LED unit is made in a single piece with the primary reflector PR2. This has the advantage that only one adjusting device (see also FIG. 6) is sufficient for the complete LED unit. Moreover, making the primary reflectors PR1, PR2 together in a single piece in this way is esthetically preferable, since this allows the laser light unit to be surrounded by the LED-unit. Such surrounding has, for example, the following advantage: This allows essentially parallel orientation of the optical axes PO1, PO2, SOL and consequently reduces angle errors.

In the context of this invention, the term "angle error" is understood to be an optical aberration that can occur when a motor vehicle headlight has modules consisting of at least one light source and at least one reflector associated with the at least one light source, these modules being separate from one another and being set up to form a common light pattern. The light patterns produced by the respective light modules are measured on a plotting screen set up transverse to the light's main direction of propagation at a distance (typically 25 meters), and the optical axes of the respective modules are adjusted so that the light pattern on the plotting screen essentially meets the requirements, preferably the legally prescribed standards (for example, the ECE regulations). An orientation of the optical axes of the modules that is inexactly parallel to a substantial extent can result in distortions in the desired light pattern after the plotting screen and in front of the plotting screen.

Figure 4:
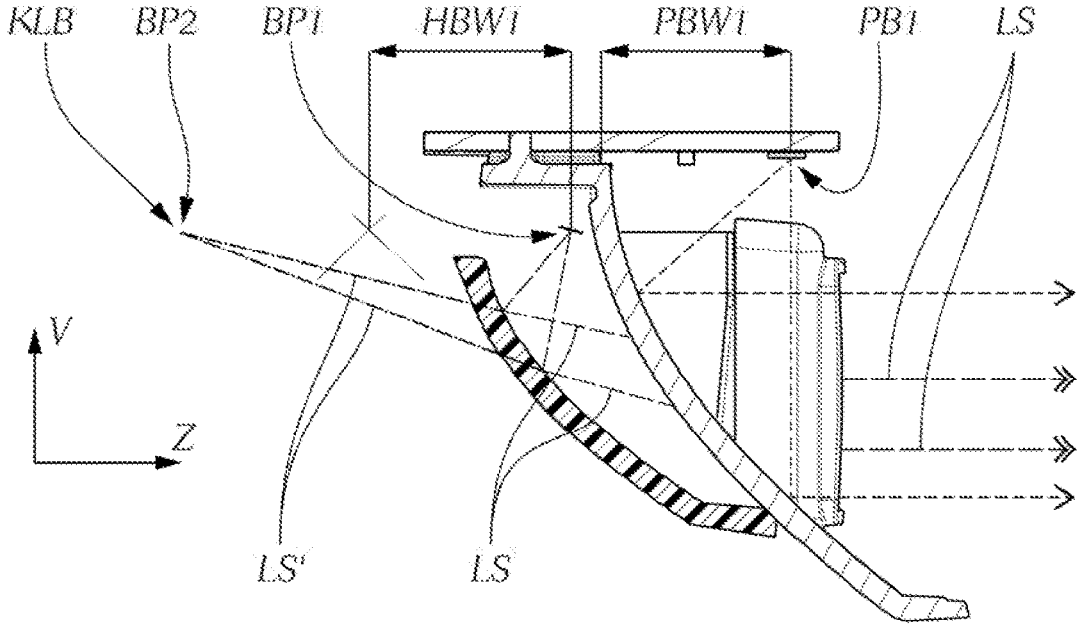
FIG. 4 is a side view of the light module.

A side view of the inventive light module presented in FIG. 4 shows a preferred arrangement of the focal points PB1, PB2, BP1, BP2, KLB of the optically relevant components of the light module. The hyperboloid shape of the secondary reflector SR1 is especially advantageous, since it keeps the focal lengths of the hyperboloid reflector small, so that the secondary light source can be arranged very close to the reflector. This makes it possible to make the installation depth of the light module smaller, e.g., than that of a light module in which the secondary reflector is in the form of a reflector of another type, for example in the form of a paraboloid reflector.

Figure 5:
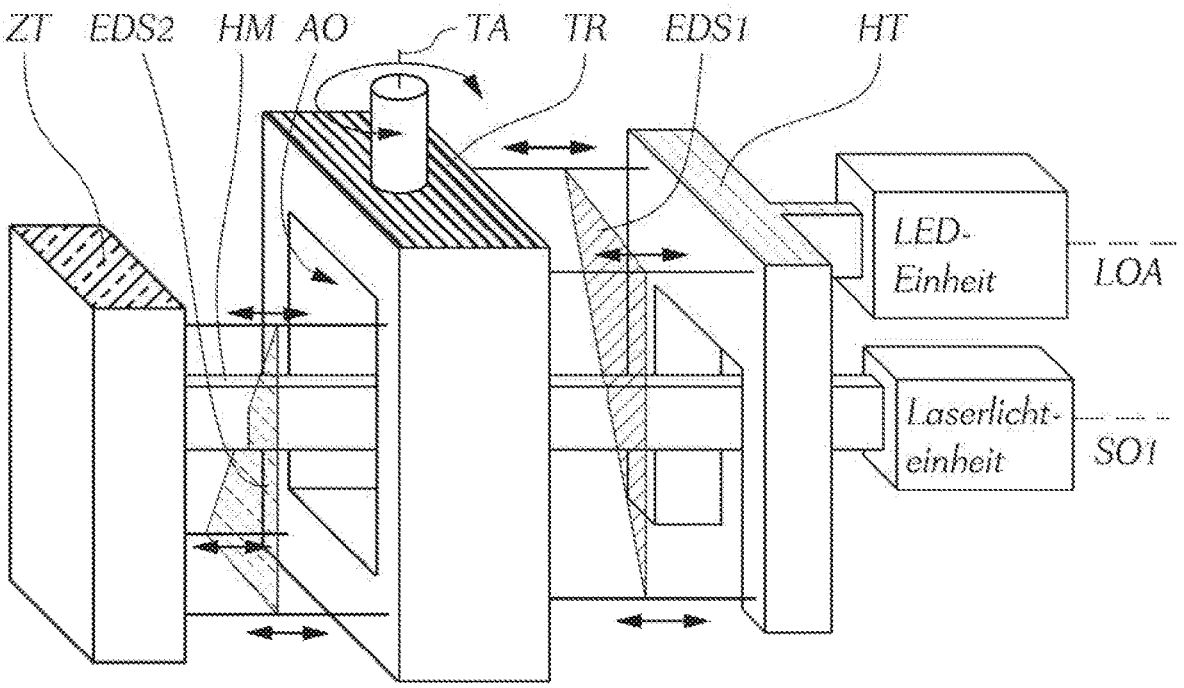
FIG. 5 is an arrangement of the essential components of the inventive lighting device.

Since the preferred sample embodiments of the light module have been illustrated, the discussion will now refer to the arrangement of the light module in a lighting device. FIG. 5 schematically shows a sample arrangement of the essential components of the inventive lighting device. The light module is shown in the form of two complete units that are separate from one another. The first complete unit (LED unit) comprises the primary light sources PLQ1, PLQ 2 described above but not shown here and the primary reflectors PR1, PR2, also described above but not shown here, and the second complete unit (laser light unit) comprises the secondary light source SLQ1, SLQ 2 described above but not shown here and the optical imaging system AS also described above but not shown here. Moreover, the lighting device has a main support HT that is set up to receive the LED unit, an additional support ZT that is set up to receive the laser light unit, and a supporting frame TR that is set up to receive both the main support HT and the additional support ZT. The supporting frame TR is pivotable about at least one axis TA (which allows the motor vehicle headlight to realize various light functions, for example curve light function), the main support and additional support held by the supporting frame TR being pivoted along with the supporting frame TR when it is pivoted. The way the supporting frame holds the main support HT and the additional support ZT allows the supports to be connected with the supporting frame TR, the position of the supports being changeable/adjustable with respect to the supporting frame (for example along the directions shown with arrows in FIG. 5). This allows, e.g., the orientation of the optical axis LOA of the LED unit to be adjusted to the optical axis SO1 of the laser light unit. Each of the supports has an adjustment triangle system to connect it to the supporting frame and to adjust it with respect to the supporting frame, the preferred embodiment shown in FIG. 5 having a first adjustment triangle system EDS1 that is set up to adjust the main support HT holding the LED unit and a second adjustment triangle system EDS2 that is set up to adjust the additional support ZT holding the laser light unit. The orientation of the first adjustment triangle system EDS1 with respect to that of the second adjustment triangle system EDS2 is rotated by 90° about the optical axis of the laser light unit SO1 (which is the same as the optical axis of the secondary reflector SR1). This simplifies the adjustment variability. However it is entirely conceivable for the adjustment triangle systems EDS1, EDS2 to be arranged so that they are not rotated at all with respect to one another, or so that they rotated at another angle, for example 180°.

In the context of this invention, the term "adjustment triangle system" is generally understood to mean an adjustment system that adjusts the support with respect to the supporting frame through three actuating elements (e.g., adjusting screws), which are pivotably connected with the corresponding support and with the supporting frame. The adjustment is normally done by means of mechanical and/or electric motor actuation means, which are associated with the lighting device. Such adjustment systems are known in the prior art (see, e.g., the applicant's application A 50329/2013).

In a preferred further development of the invention, the laser light unit has, as is shown in FIG. 5, an elongated laser light unit housing HM, which is arranged in, and can be passed through, a receiving opening AO of the supporting frame TR, this receiving opening AO being set up to receive the laser light unit housing. This makes it possible, when the additional support ZT holding the laser light unit is not connected with the supporting frame TR, for the laser light unit to be pulled out of the receiving opening AO and removed from the lighting device. This makes it substantially easier to replace the laser light unit and/or its components when technical failures occur. When both supports (the main support HT and the additional support ZT) are connected with the supporting frame TR by means of the actuating elements of the corresponding adjustment triangle systems EDS1, EDS2, the connection of the additional support ZT to the supporting frame TR is behind the supporting frame and the connection of the main support HT to the supporting frame TR is in front of the supporting frame. Here the terms "behind" and "in front of" mean that the additional support is arranged opposite the direction of travel/light exit direction from the supporting frame TR and that the main support HT is arranged in the direction of travel/light exit direction from the supporting frame TR. This makes it possible to realize a cascaded adjustment of the lighting device. In the context of this invention, "cascaded adjustment" is understood to mean an adjustment in which first the main emission direction of the lighting device can be adjusted by means of the first adjustment triangle system EDS1, and then the emission direction of the laser light unit with respect to the main emission direction can be adjusted by means of the second adjustment triangle system EDS2.

Moreover, FIG. 5 has arrows showing sample directions in which the main support and/or the additional support can be adjusted with respect to the supporting frame.

Figure 6:
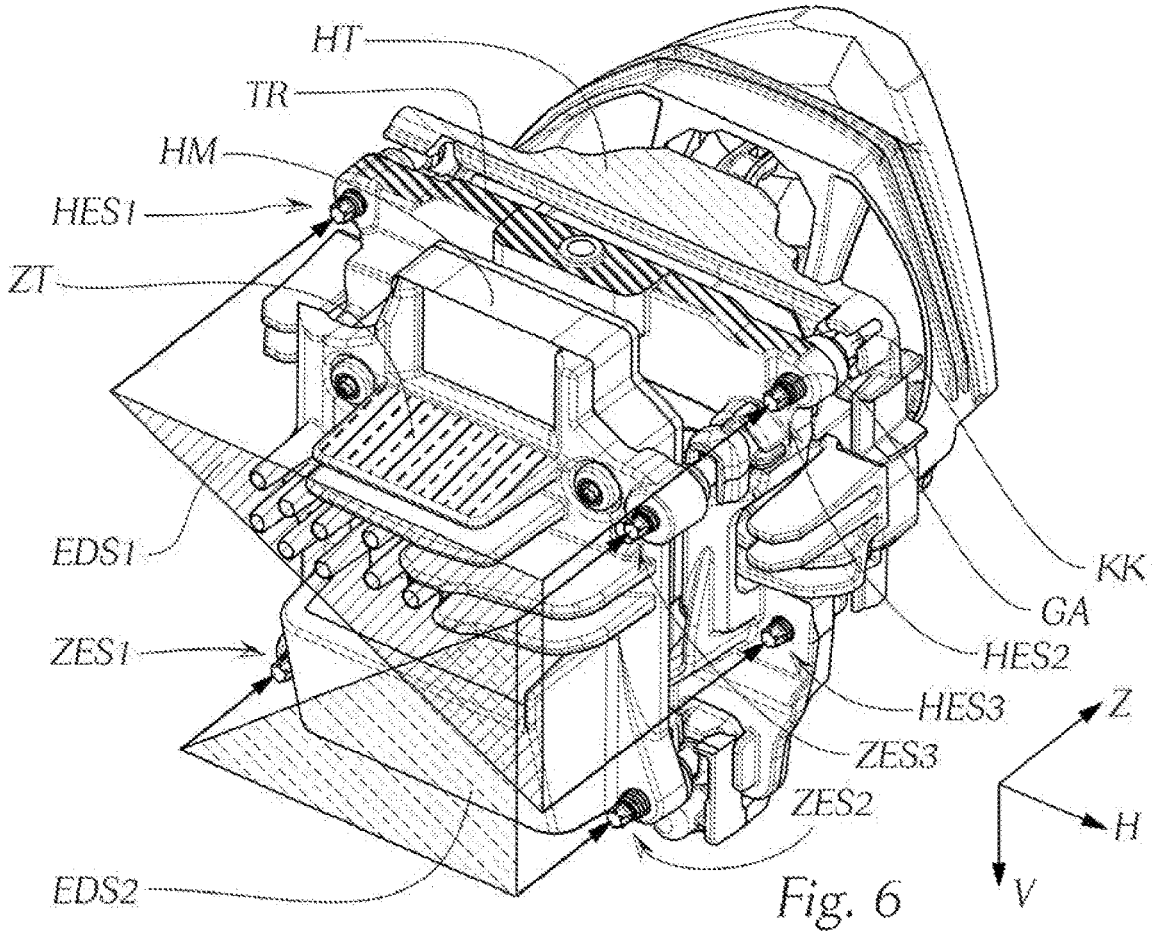
FIG. 6 is a main support and an additional support of the lighting device of FIG. 5.

FIG. 6 shows a perspective view of the lighting device of FIG. 5, in which the main support and the additional support are in the form of a heat sink. Moreover, FIG. 6 shows actuating elements of the adjustment triangles EDS1, EDS2, these actuating elements being in the form of adjusting screws ZES1, ZES2, ZES3, HES1, HES2, HES3, which are set up to engage the mechanical and/or electric motor actuation means of the adjustment triangle systems EDS1, EDS2 and to connect the main support and additional support with the supporting frame. Every adjusting screw has a thread section GA and a spherical head KK. The passages of the supporting frame and of the additional support each have a counter thread section which is set up to cooperate with the thread sections of the corresponding adjusting screws, and, on the one hand, to connect the main support and/or the additional support with the supporting frame, and, on the other hand, to adjust the position of the main support and/or the additional support with respect to the supporting frame, as can be seen in FIG. 6.

When the supporting frame is connected with the main support, the thread sections of the (three) adjusting screws HES1, HES2, HES3 are arranged in the (three) passages provided for them in the supporting frame TR in such a way that the thread sections of the adjusting screws engage into the corresponding counter thread sections of the supporting frame. When this happens, the spherical head of each adjusting screw engages into the corresponding receiving socket of the main support, this receiving socket being set up to receive a spherical head, as is shown in FIG. 6.

Furthermore, when the supporting frame TR is connected with the additional support ZT, the thread sections of the (three) adjusting screws ZES1, ZES2, ZES3 are arranged in the (three) passages provided for them in the additional support ZT so that the thread sections of the adjusting screws engage into the corresponding counter thread sections of the additional support ZT, the spherical head of each adjusting screw engaging into the corresponding receiving socket of the supporting frame, this receiving socket being set up to receive a spherical head, as is shown in FIG. 6.

The invention claimed is:

1. A light module for a motor vehicle headlight for emitting light to form a light pattern in an area in front of the light module, the light module comprising:

two or more primary light sources (PLQ1, PLQ2) that produce light to form a main light pattern (HLV), at least one secondary light source (SLQ1) that produces light to form an additional light pattern (ZLV), and exactly one primary reflector shared by the two or more primary light sources (PLQ1, PLQ2), wherein:

the additional light pattern overlaps the main light pattern to form an entire light pattern, the exactly one primary reflector is configured to bundle the light emitted from the primary light sources (PLQ1, PLQ2) and to direct it in the form of the main light pattern (HLV) into an area in front of the light module, an optical imaging system (AS) is associated with the at least one secondary light source (SLQ1) and is configured to project the light emitted from the at least one secondary light source (SLQ1) in the form of the additional light pattern (ZLV) into an area in front of the light module, and the main light pattern (HLV) is in the form of a short-range light pattern with a range between 100 meters and 350 meters, and the additional light pattern (ZLV) is in the form of a long-range light pattern with a range between 400 meters and 700 meters, and the entire light pattern (LFL) is in the form of a long-range light pattern.

2. The light module according to claim 1, wherein the primary reflector is in the form of a paraboloidal reflector.

3. The light module according to claim 1, wherein the two or more primary light sources (PLQ1, PLQ2) are in the form of LEDs.

4. The light module according to claim 1, wherein the primary reflector is a single piece.

5. The light module according to claim 1, wherein every primary light source (PLQ1, PLQ2) is arranged at a focal point (PB1, PB2) of the primary reflector.

6. The light module according to claim 1, wherein the at least one secondary light source (SLQ1) is in the form of light conversion means of a laser light unit.

7. The light module according to claim 1, wherein the primary light sources (PLQ1, PLQ2) are in the form of LEDs, and the at least one secondary light source (SLQ1) is in the form of light conversion means of a laser light unit.

8. The light module according to claim 1, wherein the optical imaging system (AS) has at least one secondary reflector (SLQ1).

9. The light module according to claim 1, wherein the optical imaging system (AS) has at least one hyperboloid reflector (SR1).

10. The light module according to claim 9, wherein the hyperboloid reflector (SR1) has auxiliary optics (KL1) in front of it.

11. The light module according to claim 9, wherein the hyperboloid reflector has a collimator lens (KL1) in front of it, the at least one secondary light source (SLQ1) being arranged at a real focal point (BP1) of the hyperboloid reflector (SR1), and the focal point (KLB) of the collimator lens (KL1) coinciding with the virtual focal point (BP2) of the hyperboloid reflector (SR1).

12. The light module according to claim 8, wherein a secondary reflector focal length (HBW1) is equal to the at least one primary reflector focal length (PBW1, PBW2).

13. The light module according to claim 1, wherein an optical axis of the imaging system (SO1) and an optical axis of the at least one primary reflector (PO1, PO2) are oriented essentially parallel to one another.

14. A light module according to claim 1, wherein the primary light sources (PLQ1, PLQ2) are arranged so that the at least one secondary light source (SLQ1) is surrounded by the primary light sources (PLQ1, PLQ2)/arranged between the primary light sources (PLQ1, PLQ2).

15. A lighting device for a motor vehicle headlight comprising the light module according to claim 1.

16. The lighting device according to claim 15, wherein the lighting device has a supporting frame (TR), a main support (HT), and an additional support (ZT), the supporting frame (TR) being configured to receive the main support (HT) and the additional support (ZT), the main support (HT) being configured to receive the primary light sources (PLQ1, PLQ2) and the primary reflector, and the additional support (ZT) being configured to receive the at least one secondary light source (SLQ1) and the optical imaging system (AS).

17. The lighting device according to claim 16, wherein the main support (HT) and/or the additional support (ZT) are/is each in the form of a heat sink.

18. The lighting device according to claim 16, wherein the main support (HT) and the supporting frame (TR) are associated with at least one first adjustment triangle system (EDS1) to adjust the main support (HT) with respect to the supporting frame (TR).

19. The lighting device according to claim 16, wherein the additional support (ZT) and the supporting frame (TR) are associated with at least one second adjustment triangle system (EDS2) to adjust the additional support (ZT) with respect to the supporting frame (TR).

20. The lighting device according to claim 16, wherein the supporting frame (TR) is pivotable about at least one axis (TA).

21. The lighting device according to claim 16, wherein the supporting frame (TR) is arranged between the additional support (ZT) and the main support (HT).

22. The lighting device according to claim 16, wherein the supporting frame (TR) is arranged behind the main support (HT) and the additional support (ZT) is arranged behind the supporting frame (TR).

23. The lighting device according to claim 16, wherein the secondary light source (SLQ1) is in the form of light conversion means of a laser light unit, and the laser light unit is arranged in a laser light unit housing (HM), this laser light unit housing (HM) being elongated and being arranged in and guidable through a receiving opening (AO) in the supporting frame (TR), this receiving opening being set up to receive the laser light unit housing.

24. The lighting device according to claim 16, wherein the supporting frame (TR) has at least three passages and the main support (HT) has at least three receiving sockets, every receiving socket of the main support corresponding to one passage of the supporting frame.

25. The lighting device according to claim 16, wherein the additional support (ZT) has at least three passages and the supporting frame (TR) has at least three receiving sockets, every receiving socket of the supporting frame (TR) corresponding to one passage of the additional support (ZT).

26. A motor vehicle headlight comprising at least one light module according to claim 1.

27. A motor vehicle comprising at least one motor vehicle headlight according to claim 26.

28. A light module for a motor vehicle headlight for emitting light to form a light pattern in an area in front of the light module, the light module comprising:

two or more primary light sources (PLQ1, PLQ2) that produce light to form a main light pattern (HLV), at least one secondary light source (SLQ1) that produces light to form an additional light pattern (ZLV), and exactly one primary reflector shared by the two or more primary light sources (PLQ1, PLQ2), wherein:

the additional light pattern overlaps the main light pattern to form an entire light pattern, the exactly one primary reflector is configured to bundle the light emitted the from the primary light sources (PLQ1, PLQ2) and to direct it in the form of the main light pattern (HLV) into an area in front of the light module, the primary reflector is a single piece and every one of the two or more primary light sources (PLQ1, PLQ2) is arranged at a focal point of the primary reflector, an optical imaging system (AS) is associated with the at least one secondary light source (SLQ1) and is configured to project the light emitted from the at least one secondary light source (SLQ1) in the form of the additional light pattern (ZLV) into an area in front of the light module, and the main light pattern (HLV) is in the form of a short-range light pattern with a range between 100 meters and 350 meters, and the additional light pattern (ZLV) is in the form of a long-range light pattern with a range between 400 meters and 700 meters, and the entire light pattern (LFL) is in the form of a long-range light pattern.

29. The light module according to claim 28, wherein the short-range light pattern is in the form of a high beam light pattern.

30. The light module according to claim 28, wherein the primary reflector has a reflective surface which has two or more segments.

* * * * *